US008597493B2

(12) United States Patent
Viljoen et al.

(10) Patent No.: US 8,597,493 B2
(45) Date of Patent: Dec. 3, 2013

(54) SYNTHETIC AVIATION FUEL

(75) Inventors: Carl Louis Viljoen, Vanderbijlpark (ZA); Vivien Louise Van Zyl, Johannesburg (ZA); Ernst Hendrik Van Tonder, Vanderbijlpark (ZA)

(73) Assignee: Sasol Technology (Pty) Ltd, Johannesburg (ZA)

( * ) Notice: Subject to any disclaimer, the term of this patent is extended or adjusted under 35 U.S.C. 154(b) by 0 days.

(21) Appl. No.: 12/772,723

(22) Filed: May 3, 2010

(65) Prior Publication Data

US 2010/0264061 A1 Oct. 21, 2010

Related U.S. Application Data

(63) Continuation-in-part of application No. PCT/ZA2008/000102, filed on Nov. 5, 2008.

(30) Foreign Application Priority Data

Nov. 6, 2007 (ZA) ..... 2007/9573

(51) Int. Cl.
*C10L 1/04* (2006.01)

(52) U.S. Cl.
USPC ..... 208/15; 585/14; 44/300

(58) Field of Classification Search
USPC ..... 208/15; 585/14
See application file for complete search history.

(56) References Cited

U.S. PATENT DOCUMENTS

| | | | | |
|---|---|---|---|---|
| 5,766,274 | A * | 6/1998 | Wittenbrink et al. | 44/436 |
| 6,309,432 | B1 * | 10/2001 | Wittenbrink et al. | 44/436 |
| 6,669,743 | B2 * | 12/2003 | Wittenbrink et al. | 44/436 |
| 6,846,402 | B2 * | 1/2005 | Hemighaus et al. | 208/14 |
| 7,294,253 | B2 * | 11/2007 | DeHaan et al. | 208/58 |
| 7,320,748 | B2 * | 1/2008 | Hemighaus et al. | 208/14 |
| 7,374,657 | B2 * | 5/2008 | Miller et al. | 208/14 |
| 7,390,397 | B2 * | 6/2008 | Lamprecht et al. | 208/308 |
| 7,608,181 | B2 * | 10/2009 | O'Rear | 208/15 |
| 7,666,294 | B2 * | 2/2010 | Bauldreay et al. | 208/15 |
| 7,785,378 | B2 * | 8/2010 | O'Rear | 44/452 |
| 7,816,570 | B2 * | 10/2010 | Roberts et al. | 585/240 |
| 7,846,323 | B2 * | 12/2010 | Abhari et al. | 208/57 |
| 7,897,824 | B2 * | 3/2011 | Aulich et al. | 585/240 |
| 8,076,522 | B2 * | 12/2011 | Clark et al. | 585/14 |
| 2007/0187292 | A1 * | 8/2007 | Miller et al. | 208/15 |
| 2007/0265479 | A1 * | 11/2007 | Landschof | 585/14 |
| 2010/0210737 | A1 * | 8/2010 | Knottenbelt et al. | 514/772 |
| 2011/0061290 | A1 * | 3/2011 | Aulich et al. | 44/308 |

OTHER PUBLICATIONS

Aulich et al., U.S. Appl. No. 60/822,637, filed Aug. 16, 2006.

* cited by examiner

*Primary Examiner* — Ellen McAvoy
(74) *Attorney, Agent, or Firm* — Knobbe Martens Olson & Bear LLP

(57) ABSTRACT

The invention relates to a Fischer-Tropsch derived aviation fuel, which fuel is used either as a fuel on its own or as a component in an aviation fuel blend, said fuel having an iso:n paraffins mass ratio above 3, at least 0.1 mass % naphthenes, <0.01 mass % polyaromatics, and <0.5 mass % aromatics.

39 Claims, No Drawings

SYNTHETIC AVIATION FUEL

CROSS-REFERENCE TO RELATED APPLICATIONS

This application is a continuation-in-part, under 35 U.S.C. §120, of International Patent Application No. PCT/ZA2008/000102, filed on Nov. 5, 2008 under the Patent Cooperation Treaty (PCT), which was published by the International Bureau in English on May 14, 2009, which designates the United States and claims the benefit of South Africa Application No. 2007/9573, filed Nov. 6, 2007, the disclosures of which are hereby expressly incorporated by reference in their entireties and are hereby expressly made a portion of this application.

FIELD OF THE INVENTION

This invention relates to an improved Fischer-Tropsch derived aviation fuel composition.

BACKGROUND OF THE INVENTION

Distillate fuel derived from the Fischer-Tropsch (FT) process is highly paraffinic and has excellent burning properties and very low sulfur. This makes Fischer-Tropsch products ideally suited for fuel use where environmental concerns are important. Clean distillates with low emission characteristics that contain low sulfur, nitrogen or aromatics such as distillates from the Fischer-Tropsch process will in the future be in great demand as aviation fuel or in blending aviation fuel.

One of the obstacles in the production of a low temperature FT (LTFT) aviation fuel is the lack of aromatics present in the fuel result in higher freezing points and lower density. The methods to overcome this are to either exclude the heavier components or include lighter components in the fuel. These methods decrease the density of the fuel further among other negative impacts on the fuel properties.

The freeze point of a fuel composition is an important factor in determining whether it is suitable for aviation use, for which low temperature conditions are experienced at high altitudes. It is vital that the fuel composition does not freeze or cause flow to be restricted during operation otherwise the consequences could be disastrous.

SUMMARY OF THE INVENTION

FT products cover a broad range of hydrocarbons from methane to species with molecular masses above 1400; including mainly paraffinic hydrocarbons and much smaller quantities of other species such as olefins and oxygenates. An FT aviation fuel product could be used on its own or in blends to improve the quality of other fuels not meeting the current and/or proposed, more stringent fuel quality and environmental specifications. The Fischer-Tropsch process has been described extensively in the technical literature, for example in Fischer-Tropsch Technology, edited by AP Steynberg and M Dry and published in the series Studies in Surface Science and Catalysis (v. 152) by Elsevier (2004).

According to a first aspect of the invention, there is provided a Fischer-Tropsch derived aviation fuel, which fuel is used either as a fuel on its own or as a component in an aviation fuel blend, said fuel having an iso:n paraffins mass ratio above 3, between 3 and 4, or even above 4.

The aviation fuel can be a jet fuel or an aviation turbine fuel.

The fuel can have at least 0.1 mass % naphthenes.

The fuel can have more than 0.5 mass % naphthenes.

The fuel can have more than 1 mass % naphthenes.

The fuel can have <0.01 mass % polyaromatics.

The fuel can have <0.5 mass % aromatics.

The distillation gradient between T90-T10 can be greater than 50° C., or even greater than 55° C.

The distillation gradient between T50-T10 can be greater than 30° C., or even greater than 40° C.

The freezing point can be below −50° C., below −55° C., or even below −60° C.

The viscosity @ 40° C. can be above 1.3 cSt; or above 1.4 cSt; or even above 1.5 cSt.

The viscosity at −20° C. is preferably below 7 $mm^2/s$.

The flash point is preferably above 45° C.

The flash point can be above 50° C., or even above 60° C.

The density @ 15° C. can be above 0.755 kg/L, or at least 0.760 kg/L or above.

At least 70 mass % of the fuel can boil below 255° C., or even below 260° C.

At least 80 mass % of the fuel can boil below 255° C., or even below 260° C.

In this description the term "distillation gradient" is an indication of the boiling range distribution of the fuel and is quantified by the difference between the temperatures at which 90 volume % and 10 volume % has evaporated and the difference between temperatures at which 50 volume % and 10 volume % has evaporated.

The term "iso:n paraffin ratio" as used herein refers to a mass ratio of branched paraffins to normal paraffins in a product, e.g., the Fischer-Tropsch derived aviation fuel. The ratio can refer to an overall ratio, to a ratio for a particular carbon number or to a ratio for range of carbon numbers.

According to a second aspect of the invention, the Fischer-Tropsch derived aviation fuel described above may be used in a multi-purpose fuel, said multi-purpose fuel having a cetane number above 65.

The fuel may have a cetane number above 70.

The fuel is believed to be an ideal multipurpose fuel as it meets and exceeds all the requirements for JP-8 and JP-5. The fluidity properties and compression ignition qualities are such that they meet the critical parameters for the application of a fuel as a multipurpose fuel.

According to a third aspect of the invention, there is provided a method of improving the yield of a Fischer-Tropsch derived aviation and/or multipurpose fuel having a density @ 15° C. of above 0.755 kg/L and a freezing point below −55° C. by isomerizing the fuel thereby increasing its iso:normal (iso:n) paraffin ratio from below 3 to above 3.

Typically the iso:n ratio is increased from below 3 to between 3 and 4.

In an embodiment, the iso:n ratio is increased from below 3 to above 4.

The density @ 15° C. can be above 0.760 kg/L.

The freezing point can be below −60° C.

The multipurpose fuel or can comprise from 1 mass % to 99 mass % of the Fischer-Tropsch derived aviation fuel of preferred embodiments, and have a cetane number above 65. Also provided is an aviation fuel blend comprising from 1 mass % to 99 mass % of the Fischer-Tropsch derived aviation fuel of preferred embodiments.

In a fourth aspect, a method for increasing a iso:normal paraffin ratio of a Fischer-Tropsch derived aviation and/or multipurpose fuel is provided, comprising: isomerizing a Fischer-Tropsch product having a iso:normal paraffin ratio below 3, whereby an isomerized Fischer-Tropsch derived aviation and/or multipurpose fuel having a iso:normal paraffin ratio above 3 is obtained, the isomerized Fischer-Tropsch derived aviation and/or multipurpose fuel having a density at 15° C. of above 0.775 kg/l and a freezing point below −55° C.

In an aspect of the fourth embodiment, an isomerized Fischer-Tropsch derived aviation and/or multipurpose fuel having an iso:normal paraffin ratio of from 3 to 4 is obtained.

In an aspect of the fourth embodiment, an isomerized Fischer-Tropsch derived aviation and/or multipurpose fuel having an iso:normal paraffin ratio of above 4 is obtained.

In an aspect of the fourth embodiment, the isomerized Fischer-Tropsch derived aviation and/or multipurpose fuel has a density @ 15° C. of above 0.760 kg/L.

In an aspect of the fourth embodiment, the isomerized Fischer-Tropsch derived aviation and/or multipurpose fuel has a freezing point of below −60° C.

In an aspect of the fourth embodiment, the Fischer-Tropsch product is a synthetic Fischer-Tropsch wax or condensate having at least 50% C10+ normal paraffins; and wherein isomerizing comprises isomerizing in a fixed or moving bed reactor under hydrocracking and/or hydroisomerization conditions using a catalyst system comprising at least one catalyst selected from the group consisting of Group 8 noble metals; Group 8 non-noble metals; Group 6 base metals on an amorphous and/or Y-Zeolitic support; Group 8 noble metals on a shape selective intermediate pore size molecular sieve support; and combinations thereof.

In an aspect of the fourth embodiment, the catalyst is selected from the group consisting of Pt on SiAl, NiMo on SiAl, ZSM-22, and SAPO-11.

DETAILED DESCRIPTION OF THE PREFERRED EMBODIMENT

The following description and examples illustrate a preferred embodiment of the present invention in detail. Those of skill in the art will recognize that there are numerous variations and modifications of this invention that are encompassed by its scope. Accordingly, the description of a preferred embodiment should not be deemed to limit the scope of the present invention.

Products of a FT hydrocarbon synthesis process, particularly the products of a cobalt and/or iron based catalytic process, contain a high proportion of normal paraffins. Primary FT products provide poor cold flow properties, making such products difficult to use where cold flow properties are vital, e.g. diesel fuels, lube oil bases and jet fuel.

The FT process is a well known process in which carbon monoxide and hydrogen are reacted over an iron, cobalt, nickel or ruthenium containing catalyst to produce a mixture of straight and branched (iso) chain hydrocarbon products ranging from methane to waxes and smaller amounts of oxygenates. This hydrocarbon synthesis process is based on the Fischer-Tropsch reaction:

$$2H_2+CO \rightarrow \sim[CH_2]\sim+H_2O$$

where ~[$CH_2$]~ is the basic building block of the hydrocarbon product molecules.

The FT process is used industrially to convert synthesis gas, which may be derived from coal, natural gas, biomass or heavy oil streams, into hydrocarbons ranging from methane to species with molecular masses above 1400. While the term Gas-to-Liquid (GTL) process refers to schemes based on natural gas (i.e. predominantly methane) to obtain the synthesis gas, the quality of the synthetic products is essentially the same once the synthesis conditions and the product work-up are defined.

While the main products are typically linear paraffinic species, other species such as branched paraffins, olefins and oxygenated components may form part of the product slate. The exact product state depends on the reactor configuration, operating conditions and the catalyst that is employed. For example this has been described in the article Catal. Rev.-Sci. Eng., 23 (1&2), 265-278 (1981) or Hydroc. Proc. 8, 121-124 (1982), the contents of which is hereby incorporated by reference in its entirety.

Preferred reactors for the production of heavier hydrocarbons are slurry bed or tubular fixed bed reactors, while operating conditions are preferably in the range of 160-280° C., in some cases 210-260° C. range, and 18-50 bar, in some cases between 20-30 bar.

The catalyst may comprise active metals such as iron, cobalt, nickel or ruthenium. While each catalyst will give its own unique product slate, in all cases the product slate contains some waxy, highly paraffinic material which needs to be further upgraded into usable products. The FT products can be hydroconverted into a range of final products, such as middle distillates, naphtha, solvents, lube oil bases, aviation fuel, etc. Such hydroconversion usually consists of a range of processes such as hydrocracking, hydroisomerization, hydrotreatment.

Table 1 provides a typical FT Product composition.

TABLE 1

| | FT Condensate (<270° C. fraction) | FT Wax (>270° C. fraction) |
|---|---|---|
| $C_5$-160° C. | 44 | 3 |
| 160-270° C. | 43 | 4 |
| 270-370° C. | 13 | 25 |
| 370-500° C. | | 40 |
| >500° C. | | 28 |

The aviation fuel of this invention can be produced from highly paraffinic feeds, i.e., synthetic FT waxes having at least 50% $C_{10}$+ normal paraffins. The feed which can more typically comprise of condensate and/or wax can be contacted in a fixed or moving bed reactor under hydrocracking and/or hydroisomerization conditions using any one or more of the following catalyst systems: a) Group 8 (noble or non-noble metal) and/or Group 6 base metal on an amorphous and/or Y-Zeolitic support, i.e. Pt on SiAl or NiMo on SiAl; and b) Group 8 noble metal on a shape selective intermediate pore size molecular sieve support, i.e. ZSM-22, SAPO-11.

The processing conditions for hydrocracking and/or hydroisomerization can be chosen quite broadly depending on what catalyst system is used and on the final product characteristics and yields required. Typical processing conditions are provided in Table 2.

TABLE 2

| Condition(s) | Broad Range |
|---|---|
| Temperature (° C.) | 200-400 |
| Pressure (bar) | 1-100 |
| LHSV ($h^{-1}$) | 0.5-20 |
| $H_2$:Feed Ratio (SCF/bbl) | 500-20 000 |

The FT aviation fuels of preferred embodiments preferably contain no detectable alpha-olefins (as determined by GC×GC characterization). The FT aviation fuels of preferred embodiments also preferably contain no detectable C5, C6, C17 or C18 n-paraffins, no detectable C5-C7 cyclic or branched paraffins, and no detectable C17 or C18 cyclic paraffins (as determined by GC×GC characterization). The FT aviation fuels of preferred embodiments preferably contain at least 15 norm. mass % each of C12, C13, C14, and C15 paraffins, and more preferably further comprise at least 8 norm. mass % of C10 and C16 paraffins and at least 5 norm. mass % C17 paraffins. Preferably, the FT aviation fuels of preferred embodiments contain less than 0.3 norm. mass % of mono aromatics. Preferably, the FT aviation fuels of preferred embodiments contain less than 0.02 norm. mass % of bicyclic aromatics. The FT aviation fuels of preferred embodiments preferably contain at least 6 norm. mass % of C10 branched paraffins; at least 10 norm. mass % of C11 branched paraffins; at least 12 norm. mass % of C12 branched paraffins; at least 11 norm. mass % of each of C13, C14, and C15 branched paraffins; at least 8 norm. mass % of C16 branched paraffins; and at least 5 norm. mass % of C17 branched paraffins. The FT aviation fuels of preferred embodiments preferably contain at least 78 norm. mass % branched paraffins. The FT aviation fuels of preferred embodiments preferably contain less than 20 norm. mass % n-paraffins. The FT aviation fuels of preferred embodiments preferably contain less than 2 norm. mass % cyclic paraffins.

EXAMPLE

Table 3 provides the properties for two examples (Example 1 and Example 2) of a FT aviation fuel according to preferred embodiments. Although they contain substantially no aromatics, the aviation fuels have a density of approximately 0.76 kg/L, a freezing point of −60° C. and a viscosity of 1.53 cSt. The fuels also have a wide boiling point distribution which meets the requirements for the distillation gradient. A flash point of above 60° C. makes the fuels suitable for use as multipurpose fuels.

TABLE 3

| Property | Units | ASTM Test Method | FT-IPK JP-8 grade | FT-IPK JP-5 grade | DEFSTAN 91-91 Issue 5 | Example 1 | Example 2 |
|---|---|---|---|---|---|---|---|
| Colour Saybolt | | D156 or D6045 | — | — | Report | >+30 | >+30 |
| Density @ 15° C. | kg/l | D4052 or D1298 | 0.751-0.845 | 0.751-0.845 | 0.775-0.840 | 0.760 | 0.762 |
| Distillation, corrected to 101,325 kPa | | D86 | | | | | |
| IBP | ° C. | | Report | Report | Report | 159 | 180.4 |
| 5% | ° C. | | | | | 171 | 187.4 |
| 10% | ° C. | | 206 max | 206 max | 205.0 max | 182 | 195.4 |
| 20% | ° C. | | | | | 194 | 202.9 |
| 30% | ° C. | | | | | 205 | 210.0 |
| 40% | ° C. | | | | | 216 | 217.5 |
| 50% | ° C. | | Report | Report | Report | 226 | 225.5 |
| 60% | ° C. | | | | | 235 | 232.8 |
| 70% | ° C. | | | | | 243 | 239.9 |
| 80% | ° C. | | | | | 251 | 246.9 |
| 90% | ° C. | | Report | Report | Report | 259 | 254.3 |
| 95% | ° C. | | | | | 264 | 258.7 |
| FBP | ° C. | | 300 max | 300 max | 300.0 max | 271 | 265.0 |
| Recovery | vol % | | >97.0 | >97.0 | >97.0 | 98.3 | 98.9 |
| Specific Energy | MJ/kg | D3338 or D4809 | — | — | 42.80 min | 44.2 | 44.2 |
| Flash Point | ° C. | D56 or D3828 | 38 min | 60 min | 38.0 min | 51 | 70 |
| Freezing Point | ° C. | D2386 or D5972 or D7153 or D7154 | minus 47 max | minus 46 max | minus 47.0 max | −60.4 | −61.3 |
| Total Acid | mgKOH/g | D3242 | — | — | 0.015 max | 0.003 | 0.001 |
| Olefins | vol % | D1319 | — | — | — | 0 | 0 |
| Paraffins | vol % | D1319 | — | — | — | 100 | 100 |
| Total Aromatics | vol % | D1319 | Report | Report | 25.0 max | 0 | 0 |
| BOCLE | mm | D5001 | — | — | 0.85 max | 0.41 | 0.52 |
| Existent Gum | mg/100 ml | D381 | — | — | 7 max | 0.7 | 0.6 |
| Filter Pressure | mmHg | D 3241 | 25 max | 25 max | 25.0 max | 1 | 0 |
| Tube Deposit Rating | | D 3241 | 3 max, no Peacock or Abnormal deposits | 3 max, no Peacock or Abnormal deposits | Less than 3, no 'Peacock' (P) or 'Abnormal' (A) deposits | <1 | <1 |
| Microsep | | D3948 | — | — | 85 min | 97 | 98 |
| Smoke Point | mm | D1322 | — | — | 25.0 min | 26 | 27 |
| Total Sulphur | mass % | D1266 or D2622 or D4294 or D5453 | 0.0015 max | 0.0015 max | 0.30 max | <0.01 | <0.01 |
| Viscosity @ −20° C. | $mm^2/s$ | D445 | 8.0 max | 8.5 max | | 5.93 | 6.59 |
| Viscosity @ 40° C. | cSt | D445 | 1.3 min | 1.3 min | — | 1.53 | 1.62 |
| Calculated Cetane Index | | D 976 | Report | Report | — | 71.7 | 78.0 |
| Naphthalenes | volume % | D 1840 | 0.1 max | 0.1 max | 3.00 max | <0.01 | <0.01 |
| T90-T10 | | | | | | 77 | 59 |
| T50-T10 | | | | | | 44 | 31 |

The results of a GC×GC characterization of the product of Example 2 are provided in Table 4.

TABLE 4

| Carbon Number | n-Paraffins Norm. Mass % | Branched Paraffins Norm. Mass % | Cyclic Paraffins Norm. Mass % | alpha-Olefins Norm. Mass % | Total Norm. Mass % |
|---|---|---|---|---|---|
| C5 | 0.000 | 0.000 | 0.000 | 0.000 | 0.000 |
| C6 | 0.000 | 0.000 | 0.000 | 0.000 | 0.000 |
| C7 | 0.002 | 0.000 | 0.000 | 0.000 | 0.002 |
| C8 | 0.087 | 0.077 | 0.009 | 0.000 | 0.173 |
| C9 | 0.629 | 1.277 | 0.073 | 0.000 | 1.979 |
| C10 | 1.708 | 6.692 | 0.171 | 0.000 | 8.571 |
| C11 | 1.329 | 10.309 | 0.185 | 0.000 | 11.824 |
| C12 | 2.991 | 12.203 | 0.155 | 0.000 | 15.349 |
| C13 | 3.794 | 11.374 | 0.138 | 0.000 | 15.306 |
| C14 | 4.346 | 11.353 | 0.111 | 0.000 | 15.810 |
| C15 | 5.042 | 11.024 | 0.104 | 0.000 | 16.170 |
| C16 | 0.057 | 8.781 | 0.067 | 0.000 | 8.905 |
| C17 | 0.000 | 5.439 | 0.000 | 0.000 | 5.439 |
| C18 | 0.000 | 0.175 | 0.000 | 0.000 | 0.175 |
| Mono Aromatics | | | | | 0.278 |
| Bicyclic Aromatics | | | | | 0.018 |
| Total | 19.987 | 78.705 | 1.012 | 0.000 | 100.000 |

For most fuel isomerization products, it is observed that the iso:n paraffin ratio increases with increasing carbon number. Surprisingly it has found that the iso:n paraffin ratio of the aviation fuel of the preferred embodiments instead decreases. The data in Table 4 illustrates this, in that the iso:n paraffin ratio follows the trend C11>C12>C13>C14>C15. The reduced amount of n paraffins relative to branched (iso) paraffins provides advantages such as superior freezing point characteristics and superiority in other properties characteristic of diesel fuels.

All references cited herein are incorporated herein by reference in their entirety. To the extent publications and patents or patent applications incorporated by reference contradict the disclosure contained in the specification, the specification is intended to supersede and/or take precedence over any such contradictory material.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term 'including' should be read to mean 'including, without limitation,' 'including but not limited to,' or the like; the term 'comprising' as used herein is synonymous with 'including,' 'containing,' or 'characterized by,' and is inclusive or open-ended and does not exclude additional, unrecited elements or method steps; the term 'having' should be interpreted as 'having at least;' the term 'includes' should be interpreted as 'includes but is not limited to;' the term 'example' is used to provide exemplary instances of the item in discussion, not an exhaustive or limiting list thereof; adjectives such as 'known', 'normal', 'standard', and terms of similar meaning should not be construed as limiting the item described to a given time period or to an item available as of a given time, but instead should be read to encompass known, normal, or standard technologies that may be available or known now or at any time in the future; and use of terms like 'preferably,' 'preferred,' 'desired,' or 'desirable,' and words of similar meaning should not be understood as implying that certain features are critical, essential, or even important to the structure or function of the invention, but instead as merely intended to highlight alternative or additional features that may or may not be utilized in a particular embodiment of the invention. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All numbers expressing quantities of ingredients, reaction conditions, and so forth used in the specification are to be understood as being modified in all instances by the term 'about.' Accordingly, unless indicated to the contrary, the numerical parameters set forth herein are approximations that may vary depending upon the desired properties sought to be obtained. At the very least, and not as an attempt to limit the application of the doctrine of equivalents to the scope of any claims in any application claiming priority to the present application, each numerical parameter should be construed in light of the number of significant digits and ordinary rounding approaches.

Furthermore, although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

What is claimed is:

1. A Fischer-Tropsch derived aviation fuel having an iso:n paraffins mass ratio of (above 3):1 and containing at least 0.1 mass % naphthenes, wherein the iso:n paraffins mass ratio decreases from C11 to C15.

2. The Fischer-Tropsch derived aviation fuel of claim 1, containing less than 0.01 mass % polyaromatics.

3. The Fischer-Tropsch derived aviation fuel of claim 1, containing less than 0.5 mass % aromatics.

4. The Fischer-Tropsch derived aviation fuel of claim 1, having a distillation gradient between T90-T10 of greater than 50° C.

5. The Fischer-Tropsch derived aviation fuel of claim 1, having a distillation gradient between T50-T10of greater than 30° C.

6. The Fischer-Tropsch derived aviation fuel of claim 1 and having a freezing point below −50° C.

7. The Fischer-Tropsch derived aviation fuel of claim 1, having a viscosity at 40° C. of above 1.3 cSt.

8. The Fischer-Tropsch derived aviation fuel of claim 1, having a viscosity at −20° C. below 7 $mm^2/s$.

9. The Fischer-Tropsch derived aviation fuel of claim 1, having a flash point above 45° C.

10. The Fischer-Tropsch derived aviation fuel of claim 9, having a density at 15° C. of above 0.755 kg/L.

11. The Fischer-Tropsch derived aviation fuel of claim 1, wherein at least 70 mass % of the fuel boils below 255° C.

12. The Fischer-Tropsch derived aviation fuel of claim 11, wherein at least 80 mass % of the fuel boils below 255° C.

13. The Fischer-Tropsch derived aviation fuel of claim 1, containing more than 0.5 mass % naphthenes, less than 0.01 mass % polyaromatics, and less than 0.5 mass % aromatics; having a distillation gradient between T90-T10of greater than 50° C., a freezing point below −50° C., a viscosity at 40° C. of above 1.3 cSt, a viscosity at −20° C. below 7 $mm^2/s$, a flash point above 45° C., and a density at 15° C. of above 0.755 kg/L; and wherein at least 70 mass % of the fuel boils below 255° C.

14. A multi-purpose fuel comprising from 1 mass % to 99 mass % of the Fischer-Tropsch derived aviation fuel of claim 1, the multipurpose fuel having a cetane number above 65.

15. An aviation fuel blend comprising from 1 mass % to 99 mass % of the Fischer-Tropsch derived aviation fuel of claim 1.

16. The Fischer-Tropsch derived aviation fuel of claim 1, containing more than 1 mass % naphthenes.

17. The Fischer-Tropsch derived aviation fuel of claim 1, wherein the iso:n paraffin ratio follows a trend C11>C12>C13>C14>C15.

18. The Fischer-Tropsch derived aviation fuel of claim 1, consisting essentially of paraffins and naphthenes.

19. The Fischer-Tropsch derived aviation fuel of claim 1, consisting of paraffins and naphthenes.

20. A Fischer-Tropsch derived aviation fuel having an iso:n paraffins mass ratio of (3.9 or above):1 and containing at least 0.1 mass % naphthenes, wherein the iso:n paraffins mass ratio decreases from C11 to C15.

21. The Fischer-Tropsch derived aviation fuel of claim 20, containing less than 0.01 mass % polyaromatics.

22. The Fischer-Tropsch derived aviation fuel of claim 20, containing less than 0.5 mass % aromatics.

23. The Fischer-Tropsch derived aviation fuel of claim 20, having a distillation gradient between T90-T10of greater than 50° C.

24. The Fischer-Tropsch derived aviation fuel of claim 20, having a distillation gradient between T50-T10of greater than 30° C.

25. The Fischer-Tropsch derived aviation fuel of claim 20, having a freezing point below −50° C.

26. The Fischer-Tropsch derived aviation fuel of claim 20, having a viscosity at 40° C. of above 1.3 cSt.

27. The Fischer-Tropsch derived aviation fuel of claim 20, having a viscosity at −20° C. below 7 $mm^2/s$.

28. The Fischer-Tropsch derived aviation fuel of claim 20, having a flash point above 45° C.

29. The Fischer-Tropsch derived aviation fuel of claim 20, having a density at 15° C. of above 0.755 kg/L.

30. The Fischer-Tropsch derived aviation fuel of claim 20, wherein at least 70 mass % of the fuel boils below 255° C.

31. The Fischer-Tropsch derived aviation fuel of claim 30, wherein at least 80 mass % of the fuel boils below 255° C.

32. The Fischer-Tropsch derived aviation fuel of claim 20, containing more than 0.5 mass % naphthenes, less than 0.01 mass % polyaromatics, and less than 0.5 mass % aromatics; having a distillation gradient between T90-T10of greater than 50° C., a freezing point below −50° C., a viscosity at 40° C. of above 1.3 cSt, a viscosity at −20° C. below 7 $mm^2/s$, a flash point above 45° C., and a density at 15° C. of above 0.755 kg/L; and wherein at least 70 mass % of the fuel boils below 255° C.

33. The Fischer-Tropsch derived aviation fuel of claim 20, wherein the iso:n paraffin ratio follows a trend C11>C12>C13>C14>C15.

34. The Fischer-Tropsch derived aviation fuel of claim 20, having an iso:n paraffins mass ratio of 3.9:1.

35. The Fischer-Tropsch derived aviation fuel of claim 20, having an iso:n paraffins mass ratio of (above 4):1.

36. A multi-purpose fuel comprising from 1 mass % to 99 mass % of the Fischer-Tropsch derived aviation fuel of claim 20, the multipurpose fuel having a cetane number above 65.

37. An aviation fuel blend comprising from 1 mass % to 99 mass % of the Fischer-Tropsch derived aviation fuel of claim 20.

38. The Fischer-Tropsch derived aviation fuel of claim 20, consisting essentially of paraffins and naphthenes.

39. The Fischer-Tropsch derived aviation fuel of claim 20, consisting of paraffins and naphthenes.

* * * * *

UNITED STATES PATENT AND TRADEMARK OFFICE

CERTIFICATE OF CORRECTION

PATENT NO. : 8,597,493 B2
APPLICATION NO. : 12/772723
DATED : December 3, 2013
INVENTOR(S) : Viljoen et al.

It is certified that error appears in the above-identified patent and that said Letters Patent is hereby corrected as shown below:

In the Claims:

In column 9 at line 34 (approx.), In Claim 5, change “T10of” to --T10 of--.

In column 9 at line 53 (approx.), In Claim 13, change “T10of” to --T10 of--.

In column 10 at line 18 (approx.), In Claim 23, change “T10of” to --T10 of--.

In column 10 at line 21 (approx.), In Claim 24, change “T10of” to --T10 of--.

In column 10 at line 40 (approx.), In Claim 32, change “T10of” to --T10 of--.

Signed and Sealed this
Twenty-fourth Day of June, 2014

Michelle K. Lee

Michelle K. Lee
*Deputy Director of the United States Patent and Trademark Office*